United States Patent [19]

Yan

[11] 4,312,838

[45] Jan. 26, 1982

[54] ION EXCHANGE RESINS OF HIGH LOADING CAPACITY, HIGH CHLORIDE TOLERANCE AND RAPID ELUTION FOR URANIUM RECOVERY

[75] Inventor: Tsoung-yuan Yan, Philadelphia, Pa.

[73] Assignee: Mobil Oil Corporation, New York, N.Y.

[21] Appl. No.: 69,688

[22] Filed: Aug. 27, 1979

[51] Int. Cl.[3] ..... C22B 60/02

[52] U.S. Cl. ..... 423/7; 75/101 BE; 423/17

[58] Field of Search ..... 423/7, 17; 75/101 BE

[56] References Cited

U.S. PATENT DOCUMENTS 2,780,514 2/1957 Lutz ..... 423/7

2,841,468 7/1958 Wilson ..... 423/7

FOREIGN PATENT DOCUMENTS 910025 11/1962 United Kingdom ..... 423/7

OTHER PUBLICATIONS

Merritt, R. C., *The Extractive Metallurgy of Uranium,* Colo. School of Mines Research Inst., 1971, pp. 138–156.

*Primary Examiner*—Deborah L. Kyle

*Attorney, Agent, or Firm*—Charles A. Huggett; Michael G. Gilman; James F. Powers, Jr.

[57] ABSTRACT

Ion exchange process for the recovery of uranium from a pregnant carbonate lixiviant employed in uranium leaching operations in which the lixiviant is passed over a precipitation inducing anionic ion exchange resin under conditions to load the resin predominantly with non-exchangeable uranium. Non-exchangeable uranium is then recovered from the resin by eluting the resin with an aqueous acid solution having a pH no greater than 2. The process is useful in those applications in which the lixiviant contains chloride ions which inhibit the adsorption of uranyl ions.

5 Claims, No Drawings

ION EXCHANGE RESINS OF HIGH LOADING CAPACITY, HIGH CHLORIDE TOLERANCE AND RAPID ELUTION FOR URANIUM RECOVERY

BACKGROUND OF THE INVENTION

This invention relates to the production of uranium and more particularly to the recovery of uranium from carbonate lixiviants through the use of precipitation inducing ion exchange resins.

Uranium is produced from uranium-bearing ores by various procedures which employ a carbonate or acid lixiviant to leach the uranium from its accompanying gangue material. The acid lixiviants usually are formulated with sulfuric acid which solubilizes uranium as complex uranyl sulfate anions. The sulfuric acid normally is used in a concentration to maintain a pH between about 0.5 to 2.0. Carbonate lixiviants contain carbonate or bicarbonate ions or mixtures thereof which function to complex the uranium in the form of water-soluble uranyl carbonate ions. The carbonate lixiviants may be formulated by the addition of alkali metal carbonates and/or bicarbonates or by the addition of carbon dioxide either alone or with an alkaline agent such as ammonia or sodium hydroxide in order to control the pH. The pH of the carbonate lixiviants may range from about 5 to 10. The carbonate lixiviants may also contain a sulfate leaching agent such as disclosed for example in U.S. patent application Ser. No. 934,933 filed Aug. 18, 1978 by Habib. The lixiviant also contains a suitable oxidizing agent such as oxygen or hydrogen peroxide.

The leaching operation may be carried out in conjunction with surface milling operations in which uranium ore obtained by mining is crushed and blended prior to leaching, heap leaching of ore piles at the surface of the earth, or in-situ leaching in which the lixiviant is introduced into a subterranean ore deposit and then withdrawn to the surface. Regardless of the leaching operation employed, the pregnant lixiviant is then treated in order to recover the uranium therefrom. One conventional uranium recovery process involves passing the pregnant lixiviant over an anionic ion exchange resin and the eluting the resin with a suitable eluant to desorb the uranium from the resin. The resulting eluate is then treated to precipitate uranium therefrom to produce the familiar "yellowcake."

The anionic ion exchange resins employed for uranium concentration are characterized by fixed cationic adsorption sites in which the mobile anion, typically chloride hydroxide, carbonate or bicarbonate, is exchanged by the uranyl complex anion. Such anionic ion exchange resins are disclosed, for example, in Merritt, R. C., THE EXTRACTIVE METALLURGY OF URANIUM, Colorado School of Mines Research Institute, 1971, pp. 138–147. Suitable anionic ion exchange resins may take the form of polymers or copolymers of styrene substituted with quaternary ammonium groups of polymers or copolymers of pyridine which are quaternized to form pyridinium groups.

The adsorption of uranium from aqueous solutions is described by Merritt at pages 147–156 where it is recognized that the presence of inorganic salts in the pregnant lixiviant tends to reduce adsorption of uranium by the anionic ion exchange resin. Thus, Merritt discloses at pages 147, 148, and 152 that high chloride ion concentrations tend to reduce the adsorption of uranium by the resin which results in decreased resin loading.

SUMMARY OF THE INVENTION

The present invention provides a new and improved process for the recovery of uranium from a carbonate lixiviant employing an anionic ion exchange resin. In carrying out the invention, the pregnant lixiviant is passed over a precipitation inducing anionic ion exchange resin under conditions to load the resin predominantly with non-exchangeable uranium. The non-exchangeable uranium is then removed from the resin by eluting it with an aqueous acid solution having a pH no greater than 2. Preferably, the pregnant lixiviant has a pH within the range of 5 to 7 when it is passed through the ion exchange resin.

DESCRIPTION OF SPECIFIC EMBODIMENTS

The anionic ion exchange resins most commonly employed in uranium recovery operations are the so-called "type I" resins in which the adsorption sites are provided by quaternary ammonium groups in which all of the quaternizing substituents are alkyl groups, normally methyl groups. The type I resins may be prepared by chloromethylation of the base polyaryl polymer and subsequent reaction with a tertiary amine such as trimethyl amine. The so-called "type II" resins may also be used in uranium recovery and are particularly useful in the concentration of uranium from lixiviants containing chloride ions which inhibit the adsorption or uranyl ions. The type II resins are characterized by cationic adsorption sites provided by quaternary ammonium groups having a hydroxyalkyl group as a quaternizing substituent. Typically the cationic adsorption sites for type II resins take the form of methylene hydroxyalkyldimethylammonium groups in which the hydroxyalkyl group contains one or two carbon atoms. The type II resins may be prepared by reaction of the chloromethylated base polymer with a tertiary amine such as dimethylethanolamine or dimethylmethanolamine.

The precipitate inducing anionic ion exchange resins employed in carrying out the present invention may be either type I or type II resins. A suitable type I resin is available from the Dow Chemical Company under the trade name MSA-1. MSA-1 is a copolymer of styrene and divinylbenzene with cationic functional groups in the form of methylene trimethylammonium groups. A suitable type II precipitation inducing resin for use in carrying out the present invention is also available from the Dow Chemical Company under the trade name MSA-2. The resin network of this polymer is also styrene-divinylbenzene copolymer. In this resin, the cationic functional groups are provided by methylene hydroxyethyldimethylammonium groups. Both of these resins are macroporous in structure. The polymer network is about 80 to 90% in gel form with the remainder of macroreticular structure.

In experimental work relative to the present invention, column resin loading tests were carried out employing the resins MSA-1 and MSA-2 identified above and three additional commerically available ion exchange resins. One of these was a type I resin available from the Dow Chemical Company under the trade name Dowex 21K. The other two were type II resins; IRA-910 available from the Rohm and Haas Company and Ionac-651 available from the Ionac Chemical Company.

In carrying out each of these tests, a glass tube having a length of 25 centimeters and an internal diameter of 0.4 centimeter was packed with 3 cubic centimeters (2 grams) of resin. The lixiviant was passed upwardly through the bed at a rate of 20 cubic centimeters per hour. In each case the lixiviant contained 200 parts per million or uranium calculated as $U_3O_8$, 1450 parts per million of bicarbonate ion, and 10,140 parts per million of sulfate ion. In one case, the lixiviant contained 500 parts per million chloride ion and in another case 2320 parts per million chloride ion. In each instance, the pH of the lixiviant was 6.5.

The results of these comparative tests are illustrated in Table I in which the first column indicates the resin employed, the second and third columns the resin loadings achieved for the relatively low salinity (500 ppm chloride ion) solution and the fourth and fifth columns the resin loadings for the relatively high salinity solutions. Columns two and four give the bed volumes of solution passed through the ion exchange columns and columns three and five set forth the resin loadings in pounds of $U_3O_8$ per cubic foot of resin achieved at a leakage of 25% (50 ppm $U_3O_8$).

TABLE I

| Resin | BV | Load. | BV | Load. |
|---|---|---|---|---|
| MSA-1 | 770 | 9.6 | 890 | 11.1 |
| MSA-2 | 570 | 7.1 | 700 | 8.8 |
| IRA-910 | 370 | 4.6 | 555 | 6.9 |
| I-650 | 380 | 4.8 | 440 | 5.5 |
| 21K | 350 | 4.4 | 365 | 4.6 |

As can be seen from an examination of the data presented in Table I, the use of the precipitation inducing resins MSA-1 and MSA-2 resulted in significantly higher resin loadings than those attained with the other resins in both the relatively low and relatively high salinity environments. The highest loading was achieved with the resin MSA-1. Continued loading of this resin with the high salinity solution resulted in a maximum loading of about 13.2 pounds of $U_3O_8$ per cubic foot of resin at a leakage of slightly more than 100 parts per million $U_3O_8$. The theoretical loading capacity of the MSA-1 corresponding to its ion exchange capacity is 10.4 pounds of $U_3O_8$ per cubic foot. Thus, the experimentally determined loading capacity was 27% in excess of the theoretical loading capacity. While applicant's invention is not to be limited by theory, it is presumed that the uranium is deposited on the resin as uranyl hydroxides, $UO_2(OH)_x^{2-x}$.

The selective precipitation of uranium by the resin in accordance with the present invention can be greatly increased by controlling the pH of the lixiviant. Thus, in further experimental work employing the resin MSA-1, column tests were carried out using the high salinity lixiviant described previously but with the pH adjusted to different values ranging from 6 to 8.5. These tests indicated that the non-exchangeable uranium increased greatly with a decrease in pH. At a pH of 8.5, 19% of the uranium loaded on the resin was non-exchangeable. The remaining 81% was exchangeable and could be desorbed from the resin by elution with an aqueous solution containing counter ions such as chloride ions. At a pH of 7.5, 71% of the uranium loaded on the resin was non-exchangeable. At pH's of 6 and 6.5, the non-exchangeable uranium constituted 96% and 94.5%, respectively, of the resin loading.

Additional experimental work was carried out employing a much higher salinity lixiviant containing 40,000 parts per million of chloride ion. The lixiviant contained 200 parts per million of uranium calculated as $U_3O_8$, 0.56 grams per liter calcium chloride, 2.1 grams per liter magnesium chloride and 64.13 grams per liter sodium chloride. In each test the lixiviant also contained 1.38 grams per liter of sodium bicarbonate and the resin employed was MSA-1. Column tests were run pH levels of 4, 5, 6 and 9. At the highest pH of 9 no loading of the resin was observed. When the pH was reduced to a value of 6, a resin loading of 1.18 pounds of $U_3O_8$ per cubic foot of resin was observed at a leakage of 170 ppm $U_3O_8$. When the pH was further reduced, to a value of 5 the resin loading increased significantly to a value of 7.6 pounds per cubic foot at a leakage of 71 ppm. A further decrease in the pH to 4 resulted in a much lower resin loading of 0.86 pounds per cubic foot at a leakage of 150 ppm.

From the foregoing it will be recognized that the pH associated with optimum resin loading varies somewhat with salinity. In a preferred embodiment of the present invention, the pH of the pregnant lixiviant is maintained at a value within the range of about 5 to 7 as the lixiviant is passed into the ion exchange column. Where the pregnant lixiviant exhibits a low to moderate salinity ranging up to about 0.5 weight percent chloride ion concentration, optimum resin loading normally will occur at a pH within a range of 6 to 7. At higher salinities above this level ranging up to 4 percent chloride ions and above the maximum resin loading will normally be found to occur at a pH range of 5 to 6.

Additional experimental work was carried out employing the above described lixiviant at a pH of 5, but with the bicarbonate concentration varying from a value of zero to 0.1 weight percent (1000 ppm). For the first run in which the lixivant was free of bicarbonate and the second run in which the lixiviant contained 250 ppm bicarbonate, the resin loading was found to be 0.86 and 4.1 pounds per cubic foot, respectively. The bicarbonate ion concentrate was doubled to a value of 500 ppm for another test. This resulted in a resin loading of 7.5 pounds per cubic foot at a leakage of 97 ppm $U_3O_8$. A further two-fold increase in the bicarbonate concentrate to a value of 1000 ppm resulted in a resin loading of 7.6 pounds per cubic foot at a leakage of 71 ppm $U_3O_8$. Thus it is advantageous in carrying out the invention to employ a lixiviant containing bicarbonate ions. Preferably the lixiviant has a bicarbonate ion concentration of at least 0.05% as it is passed into the ion exchange column.

The non-exchangeable uranium is readily recovered from the resin by eluting (or releaching) the resin with an aqueous solution of an acid such as hydrochloric, sulfuric, or nitric acid. A relatively strong acid solution having a pH of 2 or less should be employed.

The effectiveness of the acid elution step is illustrated by further experimental work carried out employing both a sodium chloride solution and a hydrochloric acid solution for elution. The resin eluted was MSA-1 loaded to 13.2 pounds of $U_3O_8$ per cubic foot as described previously. The initial eluant was an aqueous solution of 1 molar sodium chloride at a pH of 6.5. The uranium loaded resin was eluted with 10 bed volumes of the sodium chloride solution. Thereafter, a solution of 1 molar HCl was employed as the eluant. HCl flow through the ion exchange column was continued for an additional 20 bed volumes. The results of the elution experiment are set forth in Table II. In Table II, the first column sets forth the bed volumes of eluant passed through the resin, the second column the concentration of uranium (expressed as grams of $U_3O_8$) per liter in the eluate withdrawn from the ion exchange column, and the third column the cumulative amount of uranium recovered from the column expressed as the weight percent of the uranium originally in the loaded column. As can be seen from examination of Table II, during the initial elution employing the sodium chloride solution, a minor amount of uranium was recovered from the column. The uranium concentration of the rich eluate reached a maximum and then declined in a typical manner. However, the maximum uranium concentration in the eluate during this stage was quite low and after elution with 10 bed volumes of sodium chloride solution, less than 6% of the uranium originally in the column had been recovered. Shortly after the initiation of elution with the hydrochloric acid solution, the uranium concentration in the rich eluate increased dramatically, reaching a maximum of 96 grams per liter at about 15 bed volumes (5 bed volumes of acid). At the conclusion of the injection of 10 bed volumes of the acid solution, substantially all of the uranium in the resin column (calculated as 105% recovery) was eluted.

TABLE II

| BV | Conc. g/l | Rec. Wt % |
|---|---|---|
| 2 | 0.3 | — |
| 3 | 1.1 | 1.0 |
| 4.5 | 1.5 | 1.8 |
| 7 | 1.3 | 3.8 |
| 9.5 | 1.0 | 5.0 |
| 10.5 | 0.9 | 5.8 |
| 12 | 0.7 | 6.0 |
| 14 | 19.4 | 25 |
| 15 | 96.0 | 68 |
| 15.5 | 40.5 | 80 |
| 17 | 20.5 | 94 |
| 19 | 7.5 | 103 |
| 20 | 3.0 | 105 |
| 30 | 0.5 | 105 |

As indicated by the previously discussed experimental data, the precipitate inducing resins employed in the present invention are effective in saline environments and a preferred application of the invention is in uranium concentrating operations in which the pregnant lixiviant contains chloride ions which inhibit the adsorption of uranyl ions. Thus, the present invention may be employed to particular advantage in recovery operations involving lixiviants containing chloride ion concentrations of 0.1 weight percent or more.

The invention may be employed in conjunction with any type of leaching, such as mill leaching, heap leaching, or in-situ leaching.

In-situ leaching may be carried out utilizing injection and production systems as defined by any suitable well arrangements. One suitable well arrangement is a five-spot pattern in which a central injection well is surrounded by four production wells. Other patterns such as seven-spot and nine-spot patterns also may be employed as well as the so-called "line flood" pattern in which injection and production wells are located in generally parallel rows. Typically, the spacing between injection and production wells is on the order of 50 to 200 feet. In some instances, particularly where the subterranean uranium deposit is of a limited areal extent, injection and production may be carried out through the same well. Thus, in relatively thick uranium deposits, dually completed injection-production wells of the type disclosed, for example, in U.S. Pat. No. 2,725,106 to Spearow may be employed. Alternatively, injection of fresh lixiviant and withdrawal of pregnant lixiviant through the same well may be accomplished by a "huff-and-puff" procedure employing a well system such as disclosed in U.S. Pat. No. 3,708,206 to Hard et al.

In the in-situ leaching operation, the lixiviant containing suitable oxidants such as oxygen, hydrogen peroxide, or sodium chlorate is introduced into the subterranean uranium body via the injection system. The lixiviant is displaced through a desired portion of the deposit to solubilize uranium values and the pregnant lixiviant is then withdrawn through the production system to the surface. The pregnant lixiviant is then passed through one or more ion exchange columns operated in accordance with any suitable procedure. For example, the ion exchange columns may be operated in the "fixed bed" mode or in the "moving bed" mode as described in the aforementioned book by Merritt at page 167, et seq. The barren lixiviants from the ion exchange column is then circulated to a blending zone where suitable complexing and oxidixing agents are added to regenerate fresh lixiviant. The fresh lixiviant is then introduced into the subterranean ore body.

The ion exchange column is eluted by an acid eluant as described previously. The rich eluate is withdrawn from the column and the passed to a suitable zone where the uranium is recovered from the eluate by precipitation. Preferably, the eluate is treated with hydrogen peroxide in order to oxidize the uranium therein to a higher valence state at which it is precipitated as the peroxide $UO_4$ or $UO_3.O_2$.

I claim:

1. A method for the recovery of uranium from a carbonate lixiviant, comprising the steps of:
   passing said lixiviant over a type I or type II anionic ion exchange resin to cause said resin to retain uranium predominantly in the form of a precipitate, and
   recovering said precipitated uranium from said resin by contacting said resin with an aqueous acid solution having a pH no greater than 2.

2. The method of claim 1 wherein said lixiviant has a pH within the range of 5 to 7.

3. The method of claim 1 wherein said lixiviant contains chloride ions which inhibit the adsorption of uranyl ions.

4. The method of claim 1 wherein said lixiviant contains bicarbonate ions in a concentration of at least 0.05 weight percent.

5. A method for the recovery of uranium from a carbonate lixiviant, comprising the steps of:
   passing said lixiviant over a type I or type II anionic ion exchange resin to cause said resin to retain uranium predominantly in the form of a precipitate, and
   recovering said precipitated uranium from said resin by leaching with a strong acid solution.

* * * * *